United States Patent [19]

Gibson et al.

[11] 4,378,137

[45] Mar. 29, 1983

[54] MODULAR FURNITURE CONSTRUCTION

[75] Inventors: Robert Gibson, Marietta; Barry Z. Morgan, Carrollton; Quentin W. Utz, Smyrna, all of Ga.

[73] Assignee: The Singer Company, Stamford, Conn.

[21] Appl. No.: 252,541

[22] Filed: Apr. 9, 1981

[51] Int. Cl.[3] ..... A47B 87/00; F16F 12/00

[52] U.S. Cl. ..... 312/257 R; 312/108; 312/111; 312/263

[58] Field of Search ..... 312/257 R, 257 SK, 257 A, 312/263, 108, 111, 140; 108/107; 211/186

[56] References Cited

U.S. PATENT DOCUMENTS

| | | | |
|---|---|---|---|
| 419,920 | 1/1890 | Campbell | 312/263 |
| 1,340,562 | 5/1920 | Sandmann | 312/108 |
| 2,483,606 | 10/1949 | Albach et al. | 312/257 R |
| 3,329,473 | 7/1967 | Dickson | 312/111 |
| 3,736,035 | 5/1973 | Brown et al. | 312/257 SK |
| 3,784,273 | 1/1974 | Nikolai | 312/257 SK |
| 3,786,765 | 1/1974 | Burr | 312/111 |
| 3,848,942 | 11/1974 | Fanini | 312/111 |
| 3,879,096 | 4/1975 | Blodee | 312/257 R |
| 4,045,104 | 8/1977 | Peterson | 312/257 R |
| 4,123,129 | 10/1978 | Butler | 312/111 |

FOREIGN PATENT DOCUMENTS

| | | | |
|---|---|---|---|
| 695180 | 8/1953 | United Kingdom | 312/257 SK |

*Primary Examiner*—Victor N. Sakran

*Attorney, Agent, or Firm*—Robert E. Smith; Edward L. Bell

[57] ABSTRACT

A furniture construction is disclosed in which a self-supporting framework of identical and interchangeable frame members engages and maintains interchangeable exterior prefinished panel pieces, shelves, and drawer guides by means of identical and interchangeable fastening means which engage only the frame members and thus do not mar or deform the panel pieces, shelves, drawers, or the like.

3 Claims, 7 Drawing Figures

MODULAR FURNITURE CONSTRUCTION

DESCRIPTION

BACKGROUND OF THE INVENTION

This invention is in the art of furniture construction and relates to a construction and assembly technique whereby articles of furniture may be readily assembled or disassembled, and wherein the construction admits of selective rearrangement of parts of the furniture in different relationships.

Furniture construction techniques have been known in which means are provided for assembly in situ of prefinished panels, shelves, etc. using connecting framework elements. The known techniques, however, involve use of a variety of different fastenings and thus require a high degree of skill and understanding for successful assembly; many involve permanent deformation of the panels or other furniture pieces so that the assembly is in a practical sense irrevocable; and while some provide for an adjustment of shelf spacing and the like, they do not provide for selective rearrangement of the relationship of furniture parts.

SUMMARY OF THE INVENTION

It is an object of this invention to provide a furniture construction technique in which prefinished wood or simulated wood panels, shelves and the like may be securely fastened in assembled relation using a plurality of like fastening elements which do not influence deformation of any of the panels or other elements of the furniture so that reassembly in different relationship of parts is practical. It is also an object of this invention to provide, in a furniture construction of the above character, facility for accommodating selective rearrangement of the parts.

DESCRIPTION OF THE DRAWINGS

The accompanying drawings illustrate a preferred embodiment of this invention in which.

DETAILED DESCRIPTION OF THE PREFERRED EMBODIMENT

Figure 1:
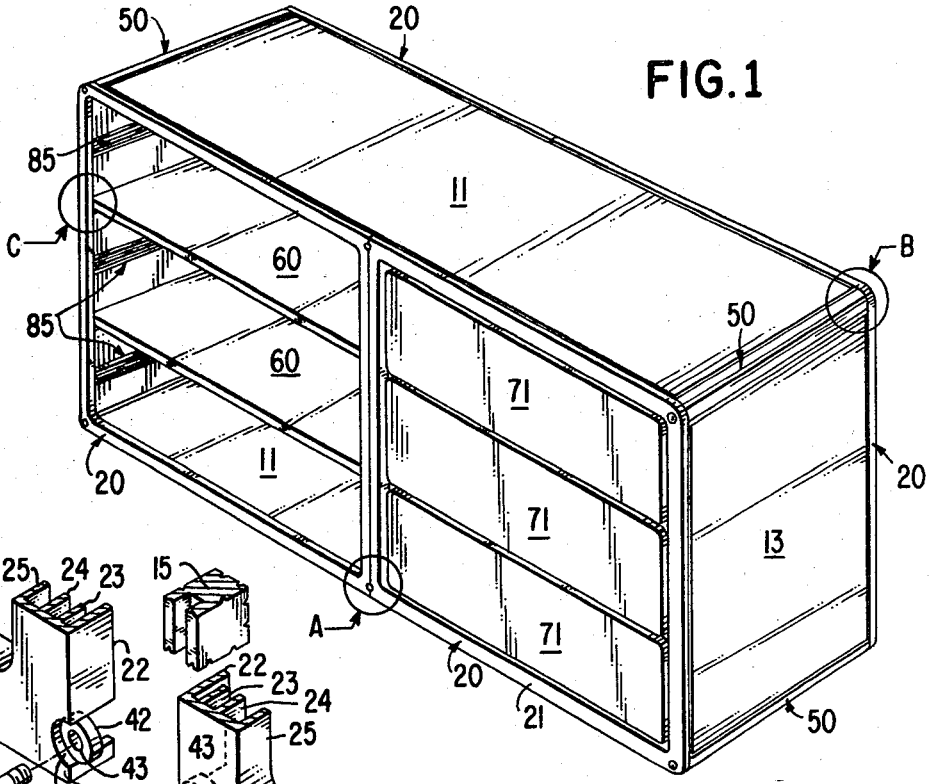
FIG. 1 represents a perspective view of an article of furniture assembled in accordance with this invention.
Figure 3:
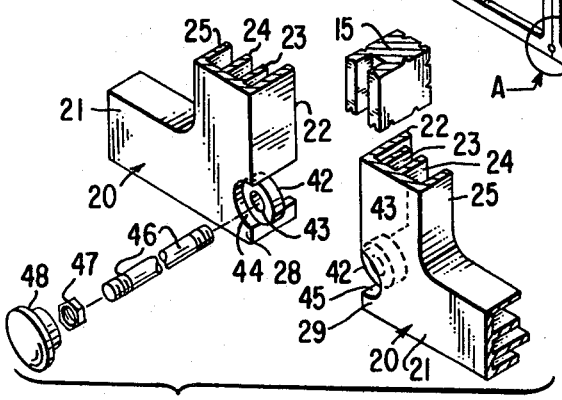
FIG. 3 represents an enlarged and exploded perspective view of that encircled portion of FIG. 1 indicated at A.
Figures 6, 7:
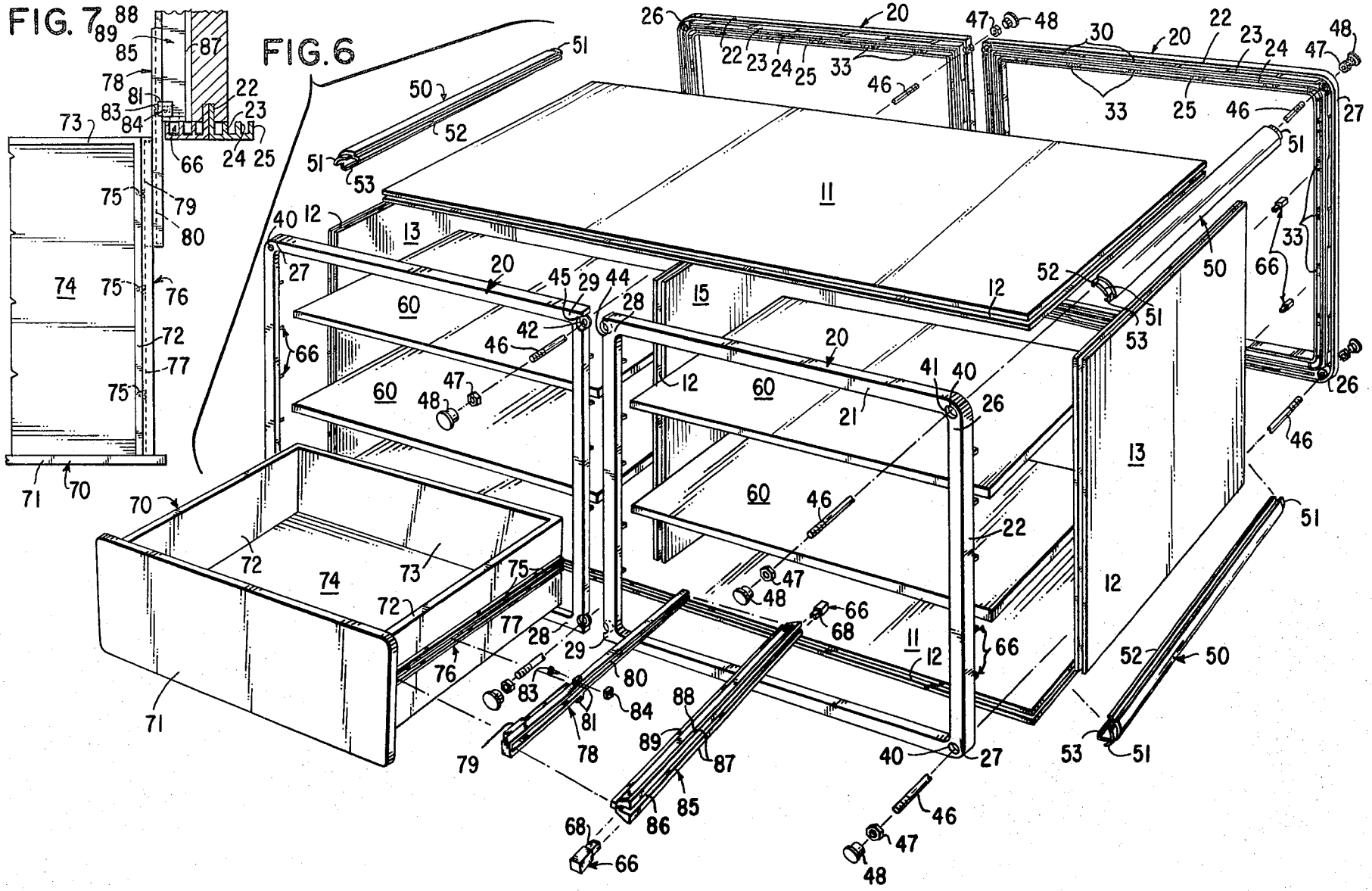
FIG. 6 is an exploded perspective view of the article of furniture illustrated in FIG. 1; and, FIG. 7 is a top plan view of a portion of a drawer showing the assembled drawer guides and a fragment of the furniture piece.

With reference to FIGS. 1 and 6, the general construction of an article of furniture in accordance with this invention will be described.

Indicated at 11 are exterior top or bottom panels of which all edges are rabbeted as at 12. Exterior side panels 13 preferably of the same thickness as a top or bottom panel and of which all edges are similarly rabbeted as at 12, are also provided. Preferrably the side panels 13 are identical and perfectly square while the top or bottom panels are rectangular with the small side equal to one dimension of a side panel while the large dimension is twice that of one dimension of a side panel plus the thickness of a panel.

As illustrated in FIG. 6, a divider panel 15 is provided midway between the side panels 13. The divider panel is preferrably identical in every dimension and interchangeable with the side panels 13.

Although the panels 11, 13 and 15 may be fabricated of any suitable material for use as furniture, they may preferrably be made of wood or wood products and they may be prefinished prior to assembly.

The panels 11, 13 and 15 are sustained in assembled relation as shown in FIG. 1 by four substantially identical frame members each indicated generally at 20. Each frame member 20 is formed with a substantially planar outside face 21 inwardly from which project four flanges 22, 23, 24 and 25. Each frame member is formed at one side with two rounded corners 26 and 27 and at the other side with two square corners 28 and 29. The innermost flange 25, the flange 24 adjacent to it and the outermost flange 22 on the three sides of the frame adjoining the rounded corners 26 and 27 project equadistant from the outside face 21 of the frame member 20.

On the side joining the square corners 28 and 29, the outermost flange 22 projects beyond the other flanges which extend equadistant from the outside face and the outside flange 22 provides, with the projecting flange 22 of an abutting frame member 20, a tongue adapted to fit into the rabbet 12 of the divider panel 15 to locate and sustain the divider panel in place.

On the three sides of the frame adjoining the rounded corners 26 and 27, the intermediate flange 23 projects beyond the other flanges and is formed with a plurality of offsets 30 so as snuggly to fit into the rabbets 12 of the top, bottom, and side panels to locate and sustain these panels in place. Re-enforcing webs 31 are formed between the flanges 22 and 23 and webs 32 are formed between the flanges 24 and 25 for re-enforcement and in order to provide reception sockets 33 for shelf and drawer supports to be described below.

As shown in FIG. 1, the frame members 20 are arranged in pairs with the square corners 28 and 29 of each pair abutting. Each rounded corner 26 and 27 of each frame member is provided with a drilled hole 40 having a counterbore 41, while each square corner 28 and 29 of each frame is provided with a circular boss 42 formed with a drilled hole 43. The circular boss 42 at the square corner 26 is spaced from the outside face 21 of the frame member 20 by a shallow semicircular counterbore 44 while the boss 42 at the square corner 27 is spaced from the outside face by a semicircular counterbore 45 which is deeper than the counterbore 44 by an amount equal to the thickness of the circular boss 42 and as a result, the bosses 42 will be superimposed when any two frames are arranged in pairs as shown in FIG. 1.

Six threaded rods 46 of the same size each with threaded nuts 47 extend through the drilled holes 40 and 43 of pairs of assembled frame members 20, one at each side of exterior top, bottom and side panels 11 and 13 to secure the exterior panels together. In this assembly, the long flanges 23 of the frame members 20 along the three sides adjoining the rounded corners 26 and 27 fit into the rabbetted edges of the panel pieces 11 and 13 to locate these panels precisely. The projecting outermost flanges 22 along the side of the frames joining the square corners 28 and 29 fit into the rabbetted edge of a divider panel 15 and locate it midway between and parallel to, the side panels 13. Plugs 48 may be provided fitting into the counterbores 41 and 44 to conceal the threaded rods and nuts 46 and 47.

Identical quarter round corner frame pieces 50 are provided for disposition between the frame members 20 at each corner of the assembled furniture piece. At each end each corner frame piece 50 is formed with a protruding lip 51 adapted to enter beneath the rounded corner 26, 27 of the outside flange 22 to interlock the corner frame piece with the frame members 20. Each corner frame piece, moreover, is formed with projecting flange elements 52 and 53 adapted to fit into and interlock with the rabbetting 12 along the edges of the exterior panels 11 and 13. The flange elements 52 and 53 may be formed with segments 54 as wide as the rabbetting for a snug fit or they may be offset in the manner of the offsets 30 of the frame member flanges 23 in order to fit snuggly into the rabbetting. Moreover, the flanges 52 and 53 may, as illustrated in FIG. 4, differ from one another in order to facilitate the molding technique by which the corner frame pieces are produced.

Figure 4:
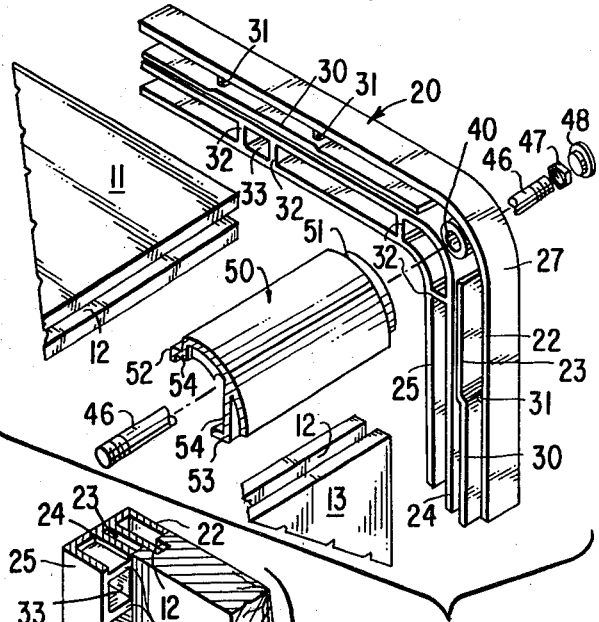
FIG. 4 represents an enlarged and exploded perspective view of that encircled portion of FIG. 1 indicated at B.
Figure 2:
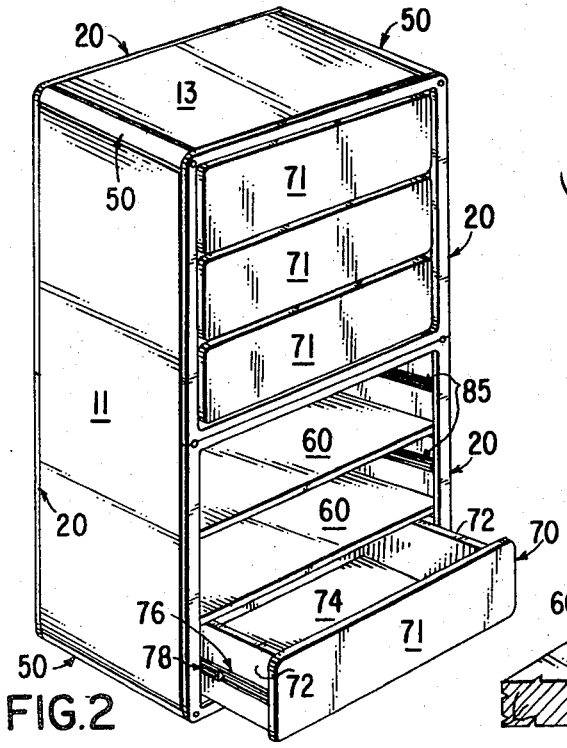
FIG. 2 represents a perspective view of an article of furniture assembled with substantially the same parts as that of FIG. 1 but in a selectively different arrangement of the parts thereof.
Figure 5:
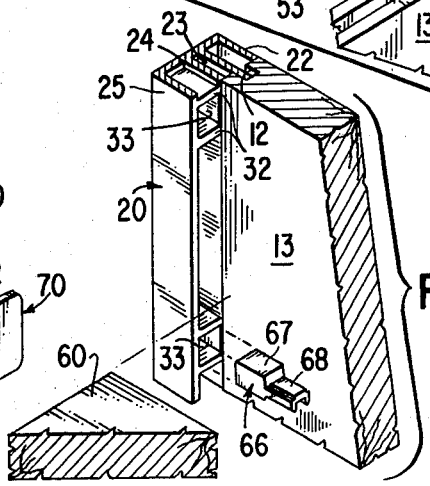
FIG. 5 represents an enlarged and exploded perspective view of that encircled portion of FIG. 1 indicated at C.

Referring particularly to FIGS. 4, 5 and 6, the manner of supporting shelves in the furniture piece of this invention will now be described. Preferrably, shelf panels 60 are provided which are not rabbetted at the edges and which are dimensioned to fit precisely between the assembled frame members 20 front to back in the furniture piece and either between the top and bottom panels 11 or between a side panel 13 and the divider panels 15 depending upon whether the horizontally or vertically elongate position of the assembled furniture piece is selected as illustrated in FIG. 1 or 2, respectively. The webs 32 between the flanges 24 and 25 of the frame members 20 are arranged so as to form with the flanges 24 and 25 a plurality of the substantially square sockets 33 spaced along the frame members 20. Shelf support pegs 66 are provided as illustrated for instance, in FIG. 5, each formed with a square end 67 adapted to be inserted in any selected socket 33 and with a channel section 68 projecting at the opposite end and adapted to protrude inwardly from the frame member when the square end is inserted in any socket 33. Preferrably, sockets 33 are arranged along the frame members 20 so as to provide for positioning of pegs 66 to extend beneath and support shelves evenly spaced within the frame openings in either the horizontal or vertical arrangement of the furniture piece of FIG. 1 or 2. With a peg 66 beneath each corner of a shelf panel 60, tendancy of the shelf to tilt will be minimized and since shelves thus supported will be confined within the frame members, the shelves cannot be removed without unthreading the nuts and dismantling the furniture piece.

Referring particularly to FIGS. 6 and 7, the manner of supporting drawers in the furniture piece of this invention will now be described.

As shown in the drawings, the furniture is adapted to accommodate drawers 70 which may be of conventional construction including drawer fronts 71, side pieces 72, a back piece 73 and a bottom section 74. Any suitable drawer pull arrangement may be employed including the use of the bottom lip of the drawer front as a drawer opening grip. Attached along the outside of each side piece 72 of the drawer as by screws 75, is a track element 76 extending substantially the full depth of the drawer and formed with slot 77 closed at each end. Slidably engaged within the slot 77 of each track element 76 is an elongated guide projection 79 which extends from a drawer slide guide 78. The drawer slide guide 78 is substantially the same length as the track element 76 but the elongated guide projection 79 extend only approximately half the length of the slot 77. At the opposite side, from the guide projection 79 each slide guide 78 is formed with a slot 80 closed at the end nearest the projection 79 and open at the other end. A pair of lugs 81 each transversely apertured to accommodate a fastening screw 83 are provided along the sides of each slide guide 78 somewhat beyond the projection 79. The fastening screw 83 is adapted to secure a stop block 84 to one of the lugs 81.

Each slide guide 78 is slidable along a drawer guide 85 which is adapted to be secured within the furniture piece, one at each side of each drawer by a peg 66 at each end. The drawer guide 85 is formed with a socket 86 adapted to accommodate the channel section 68 of a peg 66 and by this means the drawer guides 85 may be secured in place in the furniture piece when the furniture is assembled. The drawer guide 85 is preferrably formed with a wide flange 87 adapted to abut a top, bottom, side or divider panel 11, 13 or 15 to lend stability to the drawer guide 85. Each drawer guide, at the side opposite the flange 87, is formed with a shoulder 88 which projects slightly inside the frame member 20 and with a narrower drawer guiding projection 89 which extends beyond the shoulder 88.

After a furniture piece is assembled with drawer guides 85 secured in place during assembly and arranged midway along the sides of the drawer openings wherever a drawer is desired, installation of a drawer in the furniture piece simply requires that a drawer slide guide 78 be assembled in sliding engagement with the track element 76 which is secured along each drawer side piece 72 while the drawer is outside the furniture piece. Because one end of the slot 80 in each drawer slide guide 78 is open, these open ended slots may be slidably engaged with the drawer guiding projections 89 of the drawer guides 85 affixed one at each side of the drawer accommodating opening of the furniture piece, and the drawer may thus be guided into the opening.

The drawer when thus assembled into the furniture piece is then withdrawn until the back piece 73 of the drawer is substantially even with the front frame member 20 as shown in FIG. 7. In this position, the drawer slide guide will be positioned approximately half way out of the furniture piece and obtaining access from the rear of the furniture piece, stop blocks 84 are secured by the screws 83 to one lug 81 of each of the drawer slide guides inwardly of the frame member 20. The stop blocks will thus prevent complete withdrawal of the drawer from the furniture piece, and will thus maintain the assembly of the drawer supporting means.

It will be understood that instead of a drawer 70, a shelf panel 60 may be slidably supported in the furniture piece using the same assembly of track elements 76, slide guides 78 and drawer guides 85 and in this manner a sliding support for objects such as audio equipment, television, or the like, may be accommodated.

The assembly of a furniture piece in accordance with the teachings of this invention utilizes a number of like frame pieces which may be formed of synthetic plastic, metal or the like, and a number of identical fastening elements which do not engage or deface any of the prefinished panel pieces of the furniture. The furniture may thus be reassembled in different selected arrangements without regard for any previous arrangements thereof, and without requirement for special tools or special skills.

We claim:

1. A modular furniture unit construction comprising a self supporting framework of identical and interchangeable frame members, identical and interchangeable panel pieces each defining a substantially planar surface of said assembled furniture, interengaging means on said panel pieces and on said frame members, in which said interengaging means comprise interfitting tongues and grooves formed along the edges of said panel pieces and along the outer sides of said frame members for establishing and maintaining selected relationship of said panel pieces to said frame members and to each other, each inner side of each of said frame members being formed with a like number and arrangement of sockets, pegs insertable selectively in said sockets, said pegs each including support elements protruding from said frame member for supporting shelves, drawers and the like in said furniture, and a plurality of identical and interchangeable fastening means for securing said frame members into said self supporting framework without engaging or deforming said panel pieces.

2. A modular furniture unit construction comprising a self supporting framework of identical and interchangeable frame members; symetrically arranged coupling means formed on at least one side of each of said frame members facilitating joinder of a plurality of frame members along the sides formed with said coupling means into composite frame sub-assemblies one said sub-assembly arranged at the front and another said sub-assembly arranged at the back of a furniture unit, in which each side of each of said frame members utilized in said furniture unit is formed with a like number and arrangement of sockets, pegs insertable selectively in said sockets, said pegs each including support elements protruding from said frame member for supporting shelves, drawers, and the like in said furniture, a plurality of first identical and interchangeable end panel pieces extending between and interlocked with said front and said back frame sub-assemblies one said first panel piece at each extremity of said framework and one said first panel piece at each frame member joinder facilitated by said coupling means, a pair of second identical and interchangeable side panel pieces extending between and interlocked with said front and said back frame sub-assemblies, and a plurality of identical and interchangeable fastening means extending between said front and back sub-assemblies free of said first or second panel pieces.

3. A modular furniture construction as set forth in claim 1 or 2 in which for slidably supporting drawers or the like, drawer guides each formed lengthwise with a drawer guiding projection are secured in said furniture unit on pegs inserted in selected frame member sockets one drawer guide on each side of a drawer accommodating space in said furniture unit, a channeled track element is secured one to each side of said drawer, and a slide guide is interposed between each drawer guide and track element, in sliding engagement with both the drawer guiding projection of the drawer guide and with the channel of the track element.

* * * * *